US005683131A

United States Patent [19]

Lucas

[11] Patent Number: 5,683,131

[45] Date of Patent: Nov. 4, 1997

[54] WEB SLING COUPLER

[75] Inventor: Charles E. Lucas, Tulsa, Okla.

[73] Assignee: The Crosby Group, Inc., Tulsa, Okla.

[21] Appl. No.: 711,358

[22] Filed: Sep. 5, 1996

[51] Int. Cl.[6] ..... B66C 1/12

[52] U.S. Cl. ..... 294/74; 294/82.11

[58] Field of Search ..... 294/1.1, 74, 82.11, 294/89; 24/197, 200, 115 H, 115 K, 265 R, 265 BC, 265 AL

[56] References Cited

U.S. PATENT DOCUMENTS

| | | | |
|---|---|---|---|
| 2,178,170 | 10/1939 | Hager | 294/74 |
| 2,356,146 | 8/1944 | Caldwell | 294/74 |
| 3,240,526 | 3/1966 | Schopf et al. | 294/74 |
| 3,343,862 | 9/1967 | Holmes | 294/74 |
| 3,352,590 | 11/1967 | Barthule | 294/74 |
| 3,574,246 | 4/1971 | Norton | 24/68 |
| 3,583,750 | 6/1971 | Norton | 294/74 |
| 3,625,559 | 12/1971 | Lawrence | 294/74 |
| 3,837,697 | 9/1974 | Goodrich | 294/74 |
| 3,968,987 | 7/1976 | Powell | 294/82.11 |
| 4,493,135 | 1/1985 | Crook, Jr. | 24/197 |
| 4,530,534 | 7/1985 | Fredriksson | 294/74 |
| 4,993,769 | 2/1991 | Chapalain | 294/74 |
| 5,123,690 | 6/1992 | Bailey | 294/74 |

*Primary Examiner*—Dean Kramer

*Attorney, Agent, or Firm*—Head, Johnson & Kachigian

[57] ABSTRACT

A coupler for connecting a web-type sling to other fittings is comprised of a U-shaped member having legs with threaded ends that interconnect with a clasp that non-rotatably retain nuts, threaded to the legs, in sockets. The clasp includes a central arcuate saddle to receive the web sling. A pin extends across the U-shaped member legs above the arcuate saddle to retain the web sling upon the saddle.

12 Claims, 4 Drawing Sheets

WEB SLING COUPLER

BACKGROUND OF THE INVENTION

Field of the Invention

This invention is directed to slings that are used in lifting and hoisting. In particular the invention relates to web type slings that are made of fabric, such as NYLON® or Polyester or other synthetic and non-synthetic materials.

Slings made of fabric are particularly advantageous in lifting products that may be damaged if they were lifted with, for example, a wire rope sling. Typically fabric web type slings require some form of coupling or 'end member' attached to at least one end of an elongated wide strip of fabric. The end member has an opening to which the fabric is looped and stitched together. The end member also contains an eye or opening through which lifting hooks or other fittings can be inserted to lift or connect with the sling or load supports or to strap down articles.

SUMMARY OF THE INVENTION

It object of this invention to provide an improved coupler or end member for receiving and retaining fabric slings.

A further object of the invention is to provide a web sling coupler or end member through which an elongated strip of webbing material is looped and supported against lateral movement and is also easily assembled and disassembled as needed.

Specifically, the invention relates to a coupler formed by a U-bolt having legs with threaded ends. The term "U-bolt" as used herein includes shapes, as shown, that are not exactly in a U-shape. Each of the threaded ends is adapted to receive a nut as a part of the assembly. A clasp which has a top and bottom has spaced openings to receive the threaded ends of the U-bolt. The openings terminate with a skirt at the bottom of the clasp to receive, and non-rotatably retain, each assembled nut to the threaded ends of the U-bolt. Between the openings is a convex central arcuate saddle portion to receive the web sling. Once assembled, a transverse pin is inserted within aligned openings across the legs of U-bolt, which act to capture the web on the arcuate saddle and maintain the nuts within the skirt. One means of non-rotatably retaining each nut within the skirt is by designing the skirt with a socket to match the nut, i.e., a hexagonal nut within a slightly larger hexagonal skirt. In another embodiment, the bottom of the clasp includes transverse aligned openings to receive a pin to maintain the nuts within their respective sockets.

These and other objects, advantages, and features of this invention will be apparent to those skilled in the art while considering the following specification, the appended claims and the attached drawings.

DETAILED DESCRIPTION OF THE PREFERRED EMBODIMENTS

Figure 1:
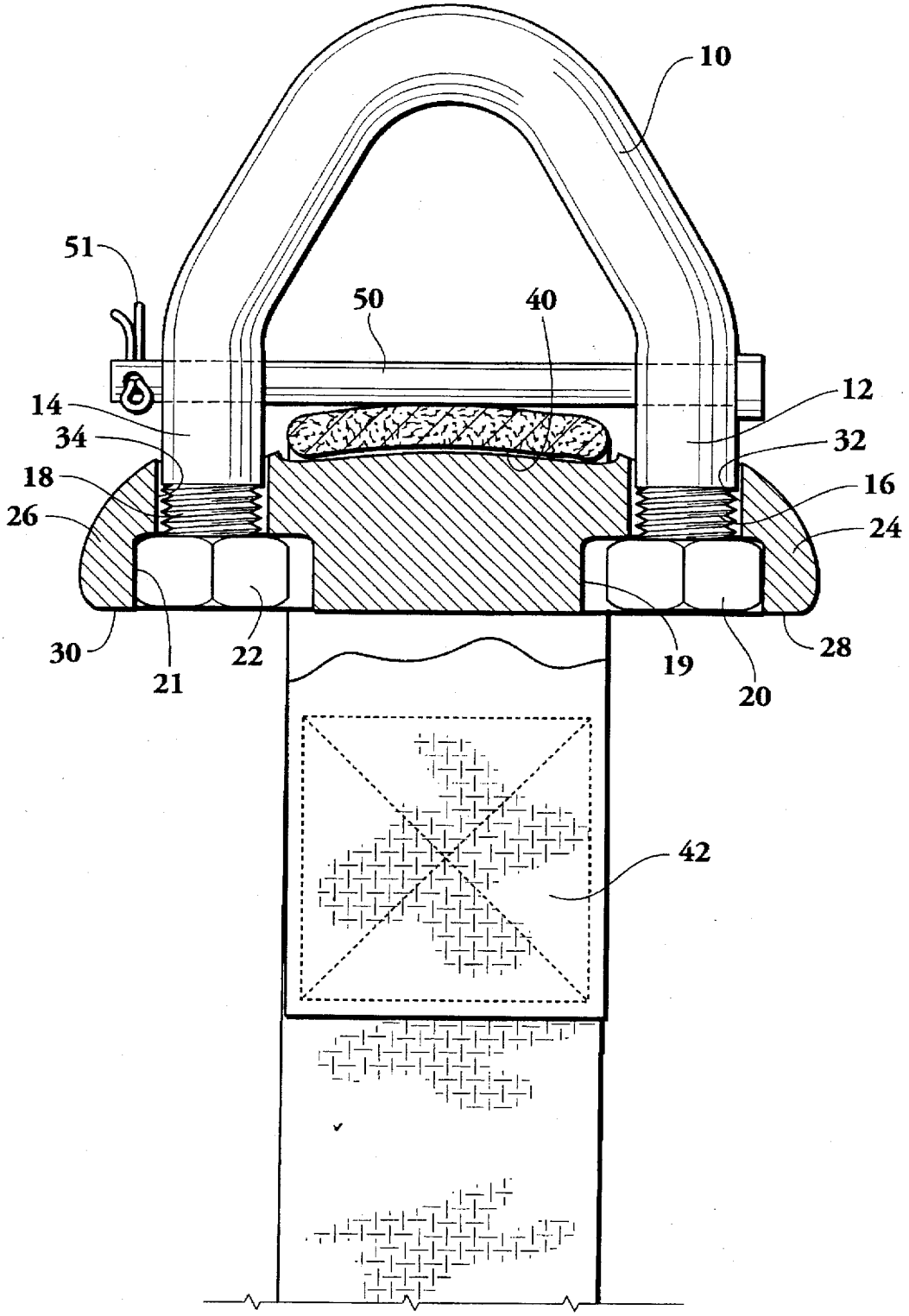
FIG. 1 is an assembly view of the coupler of this invention partly in section and cut away.
Figure 3:
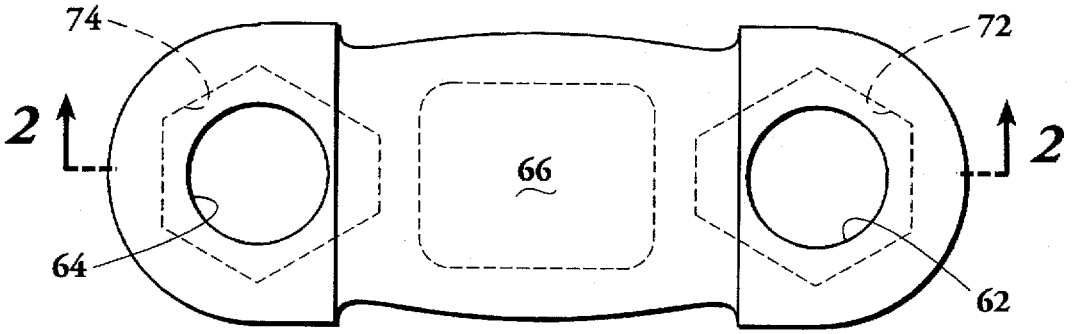
FIG. 3 is a top elevational view of the clasp of FIG. 2.

Referring now to FIG. 1, the web sling coupler of this invention comprises a U-shaped member 10 having legs 12 and 14. Each of the legs includes respective threaded ends 16 and 18 which are adapted to receive respective nuts 20 and 22. A clasp 24 includes a top portion 26 and bottom skirts 28 and 30. The clasp has spaced openings 32 and 34 for receiving a U-shaped member legs 12 and 14.

The bottom skirt of the clasp includes respective openings 19 and 21 to receive and non-rotatably retain each respective nut 20 and 22. At the top of the clasp, centrally located, is a central arcuate convex saddle 40 to receive webbing 42. Aligned openings in legs 12 and 14 of the U-shaped member 10 are adapted to receive a pin 50 such as a roll pin or other form of pin retained by a cotter pin 51 transversely across such that when assembled the pin 50 is slightly above the web sling whereby the web sling is retained upon the saddle portion of the clasp.

Referring to FIGS. 2–5, the saddle, generally designated by the numeral 60 includes spaced openings 62 and 64 to receive the legs of the U-shaped member. The center of the clasp includes the arcuate saddle portion 66 upon which the web sling rests. At the bottom of the clasp are skirt members 68 and 70 which include therein openings 72 and 74 respectively. Said openings 72 and 74 are adapted to receive and non-rotatably retain each of the nuts holding the U-shaped member therein.

In this embodiment, an additional extension of the skirts are found at 76 and 78 which have respective aligned and transverse openings 80 and 82 respectively, which are adapted to receive a pin or cotter pin therein as another means to retain each nut in the respective sockets 72 and 74.

Referring now to FIGS. 6–9, is another clasp embodiment for use in this invention. The clasp shown is indicated by the numeral 90 includes spaced openings 92 and 94 as previously described, along the bottom skirt portions 96 and 98, which have therein respective openings 100 and 102 to receive each nut of the U-shaped member.

Figure 2:
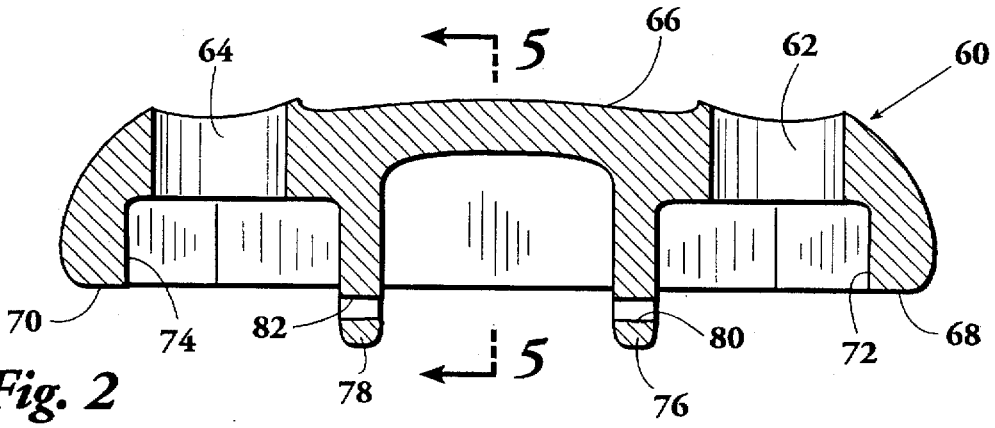
FIG. 2 is a sectional view of one form of clasp of this invention.
Figure 4:
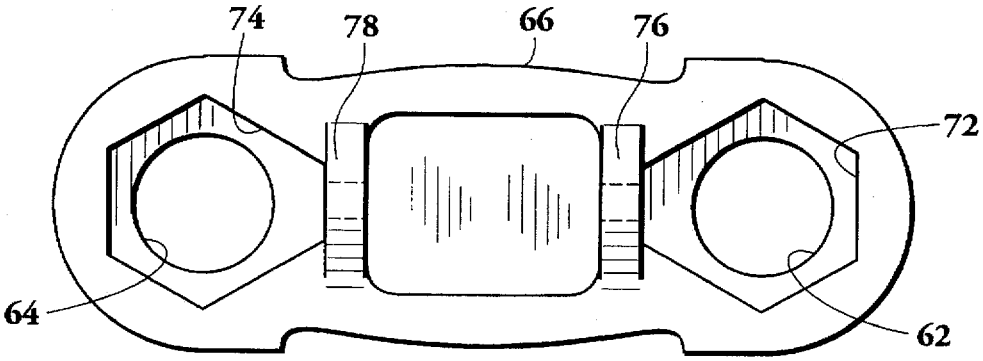
FIG. 4 is a bottom elevational view of the clasp of FIG. 2.
Figure 5:
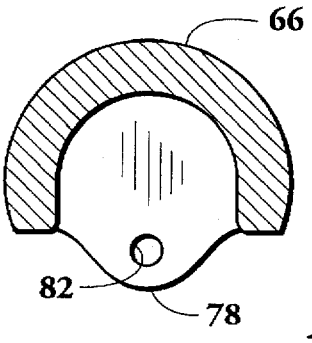
FIG. 5 is a sectional view taken along the line 5—5 of FIG. 2.
Figure 8:
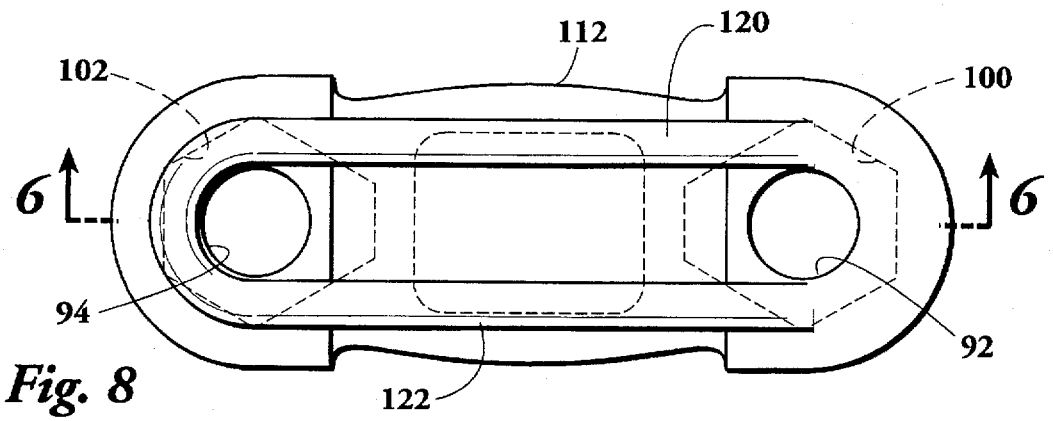
FIG. 8 is a top elevational view of the clasp of FIG. 6.
Figure 6:
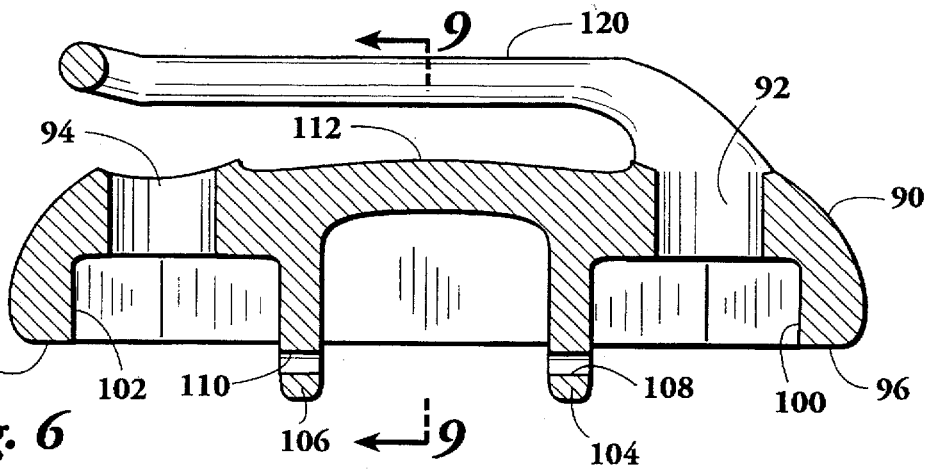
FIG. 6 is a sectional view of another form of clasp.
Figure 7:
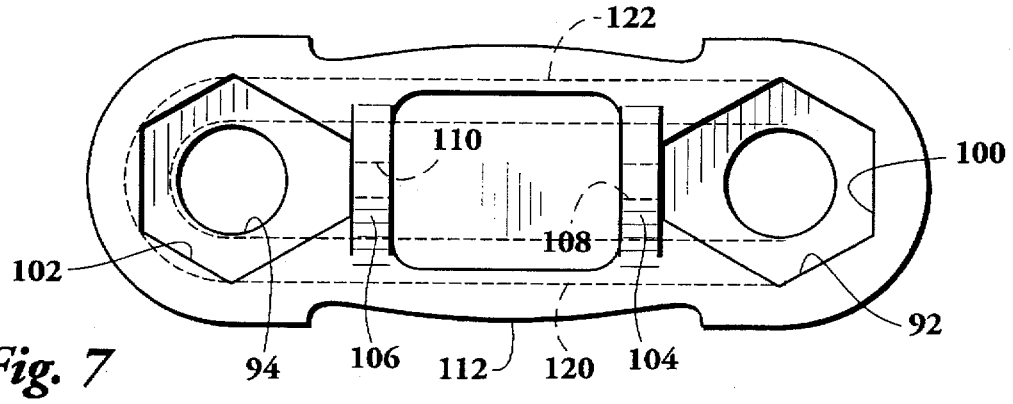
FIG. 7 is a bottom elevational view of the clasp of FIG. 6.
Figure 9:
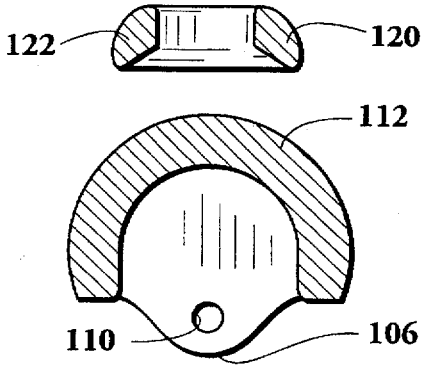
FIG. 9 is a sectional view taken along the line 9—9 of FIG. 6.

As in FIG. 2, there are skirt extensions 104 and 106. The convex saddle portion 112 is designed to receive the web sling. In lieu of a transverse pin 50 (as shown in FIG. 1), the clasp includes arm(s) 120 and 122, one end of which is formed apart of the clasp, the other end extends thereabove, providing an opening to receive the web sling.

Figure 10:
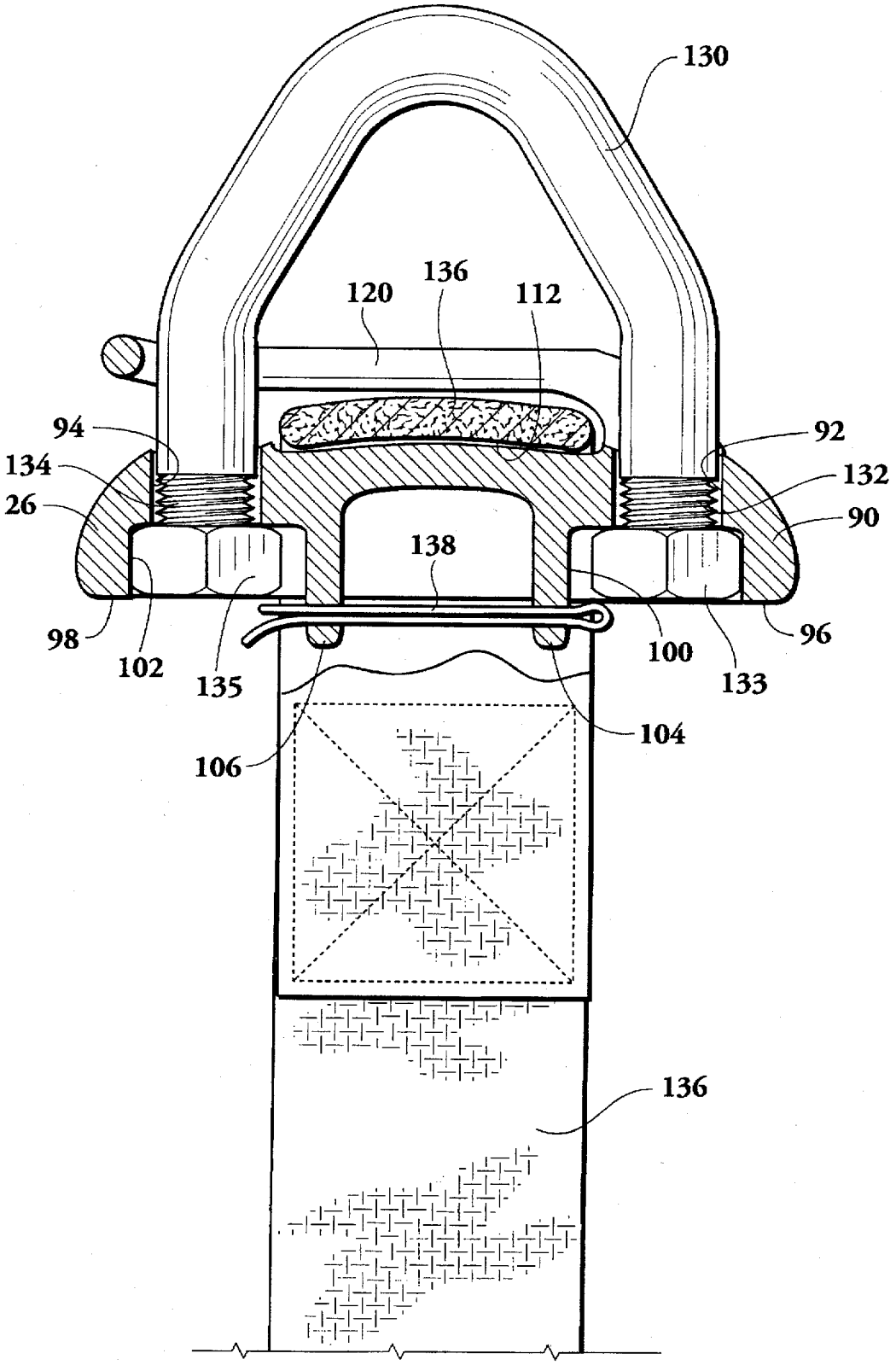
FIG. 10 is an elevational view of an assembled web coupler of the embodiment of FIGS. 6–9.

FIG. 10 depicts an assembly of U-shaped member 130 which has threaded legs 132 and 134 attached to the clasp 90 using nuts 133 and 135 which are non-rotatably retained in sockets 100 and 102. Web sling 136 is retained upon the convex saddle 112 by arms 120 and 122 in lieu of pin 50 shown in FIG. 1. Cotter pin 138 further retains the assembly as needed.

Whereas, the present invention has been described in relation to the drawings attached hereto, it should be understood that other and further modifications, apart from those shown or suggested herein, may be made within the spirit and scope of this invention.

What is claimed is:

1. A coupler for web slings comprising:

a u-shaped member having legs with threaded ends, each end to receive a nut;

a clasp, said clasp having a top and a bottom, spaced openings to receive said threaded ends of said U-shaped member, each of said openings terminating with a skirt at said bottom to receive and non rotatably retain each said nut, said clasp having a convex central arcuate saddle portion to receive a web sling; and means in said legs to receive and retain a transverse pin extending across said legs of said u-shaped member.

2. The coupler of claim 1 wherein the bottom of said clasp includes at least one transverse opening to receive a pin.

3. The coupler of claim 2 wherein said pin is one of a roll pin and cotter pin.

4. The coupler of claim 1 wherein each said skirt includes a socket to non-rotatably retain each said nut.

5. The coupler of claim 4 wherein each said nut and socket is hexagonal.

6. The coupler of claim 1 wherein said transverse pin is one of a roll pin and cotter pin.

7. An assembly of a coupler and a web sling comprising:

a U-bolt having legs with threaded ends, each end to receive a nut;

a clasp, said clasp having a top and a bottom, spaced openings to receive said threaded ends of said U-bolt, each opening terminating with a skirt at said bottom to receive and non-rotatably retain each said nut, said clasp having a convex central arcuate portion at said top to receive and retain a web sling; and a transverse pin extending across said legs of said U-bolt such that when assembled said pin is slightly above said web sling.

8. A method of assembling a web sling to a coupler, said coupler comprising:

a U-bolt having legs with threaded ends, each end to receive a nut;

a clasp, said clasp having a top and a bottom, spaced openings to receive said threaded ends of said U-bolt, each of said openings terminating with a skirt at said bottom to receive and non rotatably retain each said nut, said clasp having a convex central arcuate portion at said top to receive a web sling; and aligned transverse opening in each said legs of said U-bolt, said method comprising the steps of:

placing said web sling upon said arcuate portion;

inserting said threaded ends of said U-bolt into and through said openings and slightly beyond the bottom of said skirt;

attaching said nuts to each said threaded end;

pulling said U-bolt from said clasp such that said nuts become recessed in said respective skirt; and placing and retaining a pin in said transverse openings of said U-bolt, whereby said web sling is captured and said nuts are retained in each said skirt.

9. The method of claim 8 the additional step of placing and retaining a transverse pin into recesses across the bottom of said skirt to retain said nuts in their respective skirts.

10. A coupler for web slings comprising:

a u-shaped member having legs with threaded ends, each end to receive a nut;

a clasp, said clasp having a top and a bottom, spaced openings to receive said threaded ends of said U-shaped member, each of said openings terminating with a skirt at said bottom to receive and non rotatably retain each said nut, said clasp having a convex central arcuate saddle portion to receive a web sling, and a transverse member, one end being attached to said top and extending as a cantilever across and slightly above said saddle portion.

11. The coupler of claim 10 wherein the bottom of said clasp includes at least one transverse opening to receive a pin.

12. The coupler of claim 11 wherein said pin is one of a roll pin and cotter pin.

* * * * *